US009307582B2

(12) United States Patent
Yu et al.

(10) Patent No.: US 9,307,582 B2
(45) Date of Patent: Apr. 5, 2016

(54) MICROWAVE OVEN HAVING HOOD

(71) Applicant: LG ELECTRONICS INC., Seoul (KR)

(72) Inventors: Seonil Yu, Changwon-si (KR); Songyi Han, Changwon-si (KR); Kyoungha Lee, Changwon-si (KR); Young Woo Kim, Changwon-si (KR); Sooyeon Kim, Changwon-si (KR); Najung Cho, Changwon-si (KR)

(73) Assignee: LG Electronics Inc., Seoul (KR)

( * ) Notice: Subject to any disclaimer, the term of this patent is extended or adjusted under 35 U.S.C. 154(b) by 531 days.

(21) Appl. No.: 13/684,367

(22) Filed: Nov. 23, 2012

(65) Prior Publication Data

US 2013/0134156 A1 May 30, 2013

(30) Foreign Application Priority Data

Nov. 25, 2011 (KR) ..... 10-2011-0124439

(51) Int. Cl.
*H05B 6/64* (2006.01)
*H05B 6/80* (2006.01)
*F24C 15/20* (2006.01)

(52) U.S. Cl.
CPC ..... *H05B 6/6408* (2013.01); *F24C 15/2092* (2013.01); *H05B 6/80* (2013.01)

(58) Field of Classification Search
CPC ..... H05B 6/80; H05B 6/6408
USPC ..... 219/679, 681, 756, 757; 126/21 A, 21 R, 126/299 A, 299 D, 299 R, 273 A
See application file for complete search history.

(56) References Cited

U.S. PATENT DOCUMENTS

| | | | | | |
|---|---|---|---|---|---|
| 3,011,492 | A * | 12/1961 | Humbert | 126/299 R |
| 3,356,008 | A * | 12/1967 | Simpson et al. | 126/299 D |
| 5,690,848 | A * | 11/1997 | Lamberti | 219/450.1 |
| 6,686,576 | B1 * | 2/2004 | Yang | 219/757 |
| 6,717,123 | B1 * | 4/2004 | Kim | 219/757 |
| 6,797,930 | B2 * | 9/2004 | Kim | 219/757 |
| 6,992,273 | B2 * | 1/2006 | Yim et al. | 219/757 |
| 7,098,432 | B2 * | 8/2006 | Rew et al. | 219/757 |
| 7,470,877 | B2 * | 12/2008 | Braunisch et al. | 219/757 |
| 8,066,000 | B2 * | 11/2011 | Tsakiris | 126/299 R |
| 2003/0218012 | A1 * | 11/2003 | Kim | 219/757 |
| 2004/0016754 | A1 * | 1/2004 | Yang | 219/757 |
| 2008/0121223 | A1 * | 5/2008 | Grobleben et al. | 126/299 D |
| 2010/0200576 | A1 * | 8/2010 | Song et al. | 219/756 |
| 2010/0200578 | A1 * | 8/2010 | Song et al. | 219/757 |

FOREIGN PATENT DOCUMENTS

| | | | | |
|---|---|---|---|---|
| EP | 0337935 | A1 * | 10/1989 | F24C 15/20 |
| JP | 10-122622 | A | 5/1998 | |
| JP | 2007-192484 | A | 8/2007 | |
| KR | 1020080043912 | A | 5/2008 | |
| KR | 1020080063569 | A | 7/2008 | |

* cited by examiner

*Primary Examiner* — Thien S Tran
(74) *Attorney, Agent, or Firm* — Dentons US LLP

(57) ABSTRACT

Provided is a microwave oven having a hood. The microwave oven having the hood includes a main body having a cooking chamber in which foods are cooked and a passage through which air containing contaminants flows, a hood casing disposed on a lower portion of the main body, a first hood taken out of the hood casing, and a second hood taken out of the hood casing at a position different from that of the first hood.

14 Claims, 5 Drawing Sheets

MICROWAVE OVEN HAVING HOOD

CROSS-REFERENCE TO RELATED APPLICATIONS

The present application claims priority under 35 U.S.C. 119 and 35 U.S.C. 365 to Korean Patent Application No. 10-2011-0124439 (filed on Nov. 25, 2011), which is hereby incorporated by reference in its entirety.

BACKGROUND

The present disclosure relate to a microwave oven having a hood.

Microwave ovens are home appliances for cooking foods using microwaves. Among these microwave ovens, a microwave oven having a hood function is called a microwave hood combination over or an OTR type microwave oven.

A microwave oven according to a related art is installed at a side of a kitchen. The microwave oven is installed above other cooking equipment, e.g., a gas oven range. Also, the microwave oven includes a hood. The hood is installed on the bottom surface of the microwave oven to suction air containing contaminants generated when the cooking equipment cooks foods. Although not shown, a suction device for suctioning air containing contaminants through the hood is installed within the microwave oven.

However, the microwave oven having the hood according to the related art has the following limitations.

First, the hood is fixed to the bottom surface of the microwave oven. Thus, substantially, it is difficult to efficiently prevent air containing contaminants from being diffused into a region corresponding to the outside of the hood.

Also, the hood has a flat bottom surface. Thus, a rear end of the hood disposed on a rear end of the bottom surface of the microwave oven is relatively far from the cooking equipment. Therefore, it may be difficult to efficiently suction air containing contaminants generated when the cooking equipment cooks foods through the hood.

SUMMARY

Embodiments provide a microwave oven having a hood.

In one embodiment, a microwave oven having a hood includes: a main body having a cooking chamber in which foods are cooked and a passage through which air containing contaminants flows; a hood casing disposed on a lower portion of the main body; a first hood taken out of the hood casing; and a second hood taken out of the hood casing at a position different from that of the first hood.

In another embodiment, a microwave oven having a hood includes: a main body having a cooking chamber in which foods are cooked and a passage through which air containing contaminants flows; a hood casing disposed on a bottom surface of the main body, the hood casing having a main suction hole for suctioning the air containing the contaminants; a first hood slid forward and backward with respect to the hood casing so that the first hood is taken out of the hood casing; and a second hood linked with the sliding of the first hood and tiled with a preset angle with respect to the hood casing so that the second hood is taken out of the hood casing.

In further another embodiment, a microwave oven having a hood includes: a main body having a cooking chamber in which foods are cooked and a passage through which air containing contaminants flows; a hood casing disposed on a bottom surface of the main body, the hood casing having a main suction hole for suctioning the air containing the contaminants; a first hood taken out of the hood casing forward from the inside of the hood casing; and a second hood tiled at a predetermined angle from the inside of the hood casing and taken out of the hood casing.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
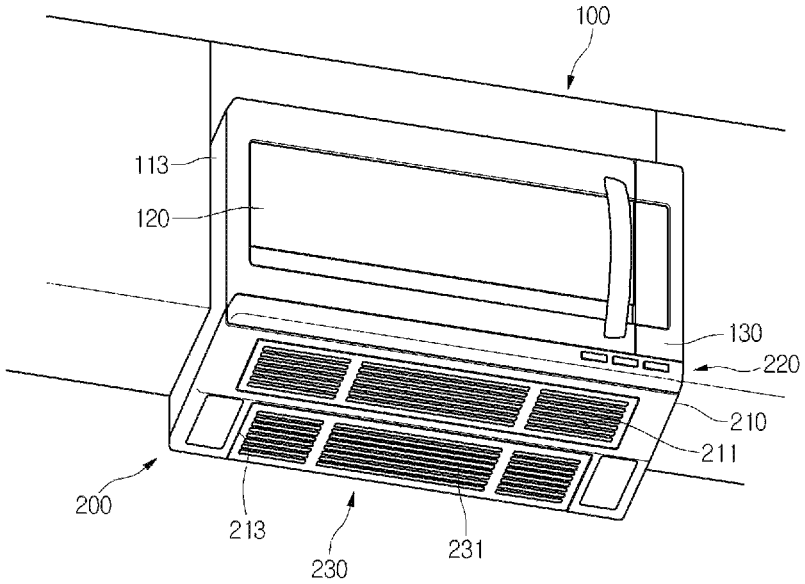
FIG. 1 is a perspective view illustrating a state in which a microwave oven having a hood is installed in a kitchen according to a first embodiment.
Figure 2:
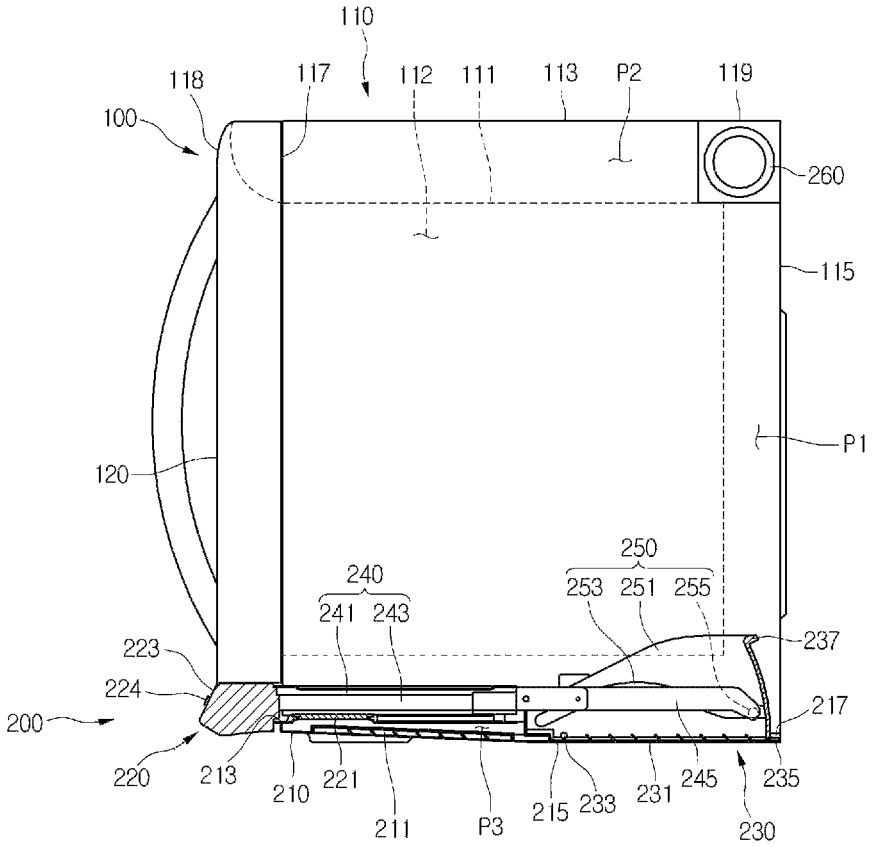
FIG. 2 is a cross-sectional view of the microwave oven having the hood according to the first embodiment.

FIG. 1 is a perspective view illustrating a state in which a microwave oven having a hood is installed in a kitchen according to a first embodiment. FIG. 2 is a cross-sectional view of the microwave oven having the hood according to the first embodiment.

Referring to FIGS. 1 and 2, a microwave oven having a hood 100 (hereinafter, referred to as a "microwave oven") according to a first embodiment includes a main body 110.

The main body 110 has a cavity 111 therein. The cavity 111 may have an approximately hexahedral shape with an opened front side. A cooking chamber 112 in which foods are cooked is defined in the cavity 111.

A top surface and both side surfaces of the main body 110 are defined by an outer casing 113. Also, an outer appearance of a rear surface of the main body 110 is defined by a back plate 115. Here, a top surface of the cavity 111 and a top surface of the outer casing 113 are spaced apart from each other. Also, a rear surface of the cavity 111 and a front surface of the back plate 115 are spaced apart from each other. Substantially, a connection passage P1 is defined between the rear surface of the cavity 111 and the front surface of the back plate 115. An indoor exhaust passage P2 is defined between the top surface of the cavity 111 and the top surface of the outer casing 113. Thus, an upper end of the connection passage P1 and a rear end of the indoor exhaust passage P2 communicate with each other.

An indoor exhaust hole 117 is defined in the main body 110. The indoor exhaust hole 117 is defined in a front upper end of the main body 110. The indoor exhaust hole 117 serves as an outlet through which air is discharged from the inside of the main body 10 into an indoor space.

Also, an exhaust grill 118 is disposed in a front side of the indoor exhaust hole 117. The exhaust grill 118 guides air exhausted through the indoor exhaust hole 117 upward. Also, the exhaust grill 118 may be covered by a door 120 in a state where the door 120 covers the cooking chamber 112. Alternatively, the air exhausted into the indoor space through the indoor exhaust hole 117 may be guided forward by the exhaust grill 118. In this case, the exhaust grill 118 may not be covered by the door 120.

An outdoor exhaust hole 119 is defined in a top surface of the outer casing 113. The outdoor exhaust hole 119 serves as an outlet through which air is discharged from the inside of the main body 10 into an outdoor space. Substantially, the outdoor exhaust hole 119 is defined by cutting a portion of the top surface of the outer casing 113 corresponding to a direct upper side of the connection passage P1. Although not shown, a duct for discharging the air exhausted through the outdoor exhaust hole 119 into the outdoor space is connected to the outdoor exhaust hole 119. Also, the door 120 is rotatably disposed on the main body 110. The door 120 selectively opens or closes the cooking chamber 112.

Also, a control panel 130 is disposed on a front surface of the main body 110. The control panel 130 receives a signal for operating the microwave oven 100 to display information related to the operation of the microwave oven 100.

A hood device 200 is disposed in on a lower portion of the main body 110. The hood device 200 is configured to suction air containing contaminants generated when foods are cooked in cooking equipment (not shown) disposed under the microwave oven 100 into the main body 110. The hood device 200 may include a hood casing 210, first and second hoods 220 and 230, guide members 240 and 250, an elastic member, and a locking unit.

In detail, the hood 210 has an approximately polygonal shape with an opened top surface. The hood casing 210 is fixed to the bottom surface of the main body 110. Thus, a space for receiving the first and second hoods 220 and 230 and a main suction passage P3 through which air suctioned into the main body 110 flows are defined between the bottom surface of the main body 110 and an inner surface of the hood casing 210. A rear end of the main suction passage P3 communicates with a lower end of the connection passage P1.

A main suction hole 211 is defined in the hood casing 210. The main suction hole 211 is defined in a front portion of the hood casing 210. The air containing contaminants is suctioned into the main suction passage P3 through the main suction hole 211.

A first opening 213 is defined in a front surface of the hood casing 210. Also, a second opening 215 is defined in a bottom surface of the hood casing 210. A portion of the front surface of the hood casing 210 is cut to define the first opening 213. The first opening 213 serves as an entrance through which the first hood 220 is taken in or out. A portion of a rear end of the bottom surface of the hood casing 210 corresponding to a rear side of the main suction hole 211 is cut to define the second opening 215. The second opening 215 may serve as an entrance through which the second hood 230 is taken in or out.

A hook rib 217 is disposed on the hood casing 210. The hook rib 217 is disposed on a side of the rear end of the hood casing 210. Here, the hook rib 217 is spaced upward from the bottom surface of the hood casing 210. The hook rib 217 is spaced by a distance corresponding to a thickness of a first stopper 235 (that will be described later) upward from the bottom surface of the hood casing 210.

Figure 4:
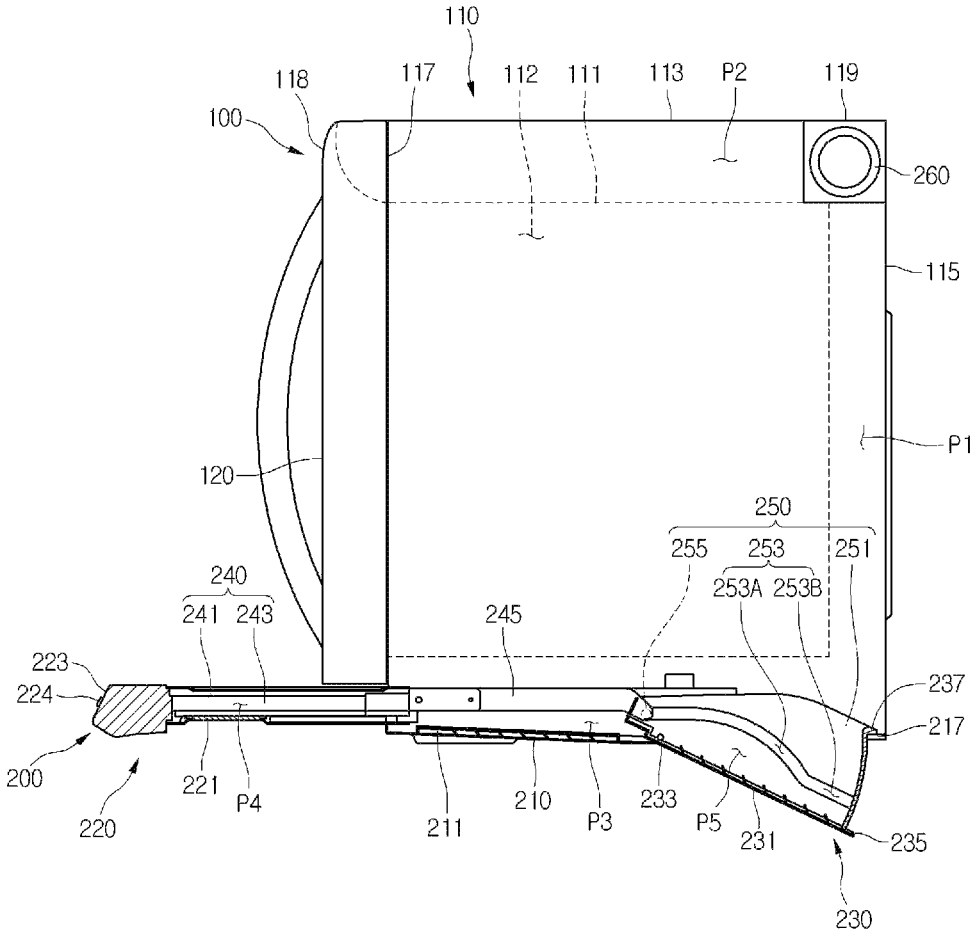

The first hood 220 is disposed accessible inside/outside the hood casing 210 through the first opening 213. In detail, the first hood 220 is slid forward or backward with respect to the hood casing 210 (or the main body 110). Hereinafter, as shown in FIG. 2, a position at which the first hood 220 is received into the hood casing 210 is called a first reception position. Also, as shown in FIG. 4, a position at which the first hood 220 is withdrawn to the outside of the hood casing 210 is called a first withdrawal position.

The first hood 220 has an approximately cross section corresponding to that of the first opening 213 and an opened rear surface having a polygonal shape. A first auxiliary suction passage P4 is defined in the first hood 220. A rear end of the first auxiliary suction passage P4 communicates with the main suction passage P3 in a state where the first hood 220 is disposed at the first withdrawal position at which the first hood 200 is withdrawn to the outside of the hood casing 210. The first hood 220 is designed to have a size within a range in which the first hood 220 does not interfere with the suction of the air containing the contaminants through the main suction hole 211 by the first hood 220. That is, in the state where the first hood 220 is disposed at the first withdrawal position, the rear end of the first hood 220 may be disposed on the front side of the main suction hole 211 or the same virtual vertical plane as the front end of the main suction hole 211. The first auxiliary suction passage P4 may be defined only in the state where the first hood 220 is withdrawn to the outside of the hood casing 210, i.e., the first hood 220 is disposed at the first withdrawal position.

Also, a first auxiliary suction hole 221 is defined in the first hood 220. The air containing the contaminants is suctioned into the first auxiliary suction passage P4 through the first auxiliary suction hole 221.

Also, a front panel 223 is disposed on the front surface of the first hood 220. A manipulation button 224 receiving a signal for an operation of the microwave oven 100 may be disposed on the front panel 223. The manipulation button 224 may receive, for example, a signal for operating a suction fan 260 and lamp which will be described later.

The second hood 230 is disposed accessible inside/outside the hood casing 210. In detail, the second hood 230 may be tilted at a predetermined angle with respect to the hood casing 210 (or the main body 110). In the current embodiment, the second hood 230 may be taken in or out of the hood casing 210 by being linked with the take-in/out of the first hood 220 into/form the hood casing 210. This description will be described together with the guide members 240 and 250 in detail.

The second hood 230 has an approximately cross section corresponding to that of the second opening 215 and opened front and top surfaces, each having a polygonal shape. The second hood 230 defines a second auxiliary suction passage P5. An upper end of the second auxiliary suction passage P5 communicates with a rear end of the main suction passage P3 when the second hood 230 is withdrawn to the outside of the hood casing 210. The second auxiliary suction passage P5 may be defined only in the state where the second hood 230 is withdrawn to the outside of the hood casing 210, i.e., the second hood 230 is disposed at the second withdrawal position.

In the state where the second hood 230 is received within the hood casing 210, the bottom surface of the second hood 230 is disposed on the same virtual plane as that of the hood casing 210. Alternatively, in the state where the second hood 230 is received within the hood casing 210, the bottom surface of the second hood 230 may be disposed on a virtual plane parallel to the bottom surface of the hood casing 210. Also, in the state where the second hood 230 is tilted at a preset angle with respect to the hood casing 210 and then withdrawn to the outside of the hood casing 210, the end of the second hood 230 is tilted at a predetermined angle with respect to the bottom surface of the hood casing 210 to face a front side. Hereinafter, as shown in FIG. 2, a position at which the second hood 230 is received into the hood casing 210 is called a second reception position. Also, as shown in FIG. 4, a position at which the second hood 230 is withdrawn to the outside of the hood casing 210 is called a second withdrawal position.

Also, a second auxiliary suction hole 231 is defined in the second hood 230. Air containing contaminants is suctioned into the second auxiliary suction passage P5 through the second auxiliary suction hole 231. Thus, the second auxiliary suction hole 231 may be disposed on the same plane as the bottom surface of the hood casing 210 or on a virtual plane parallel to the bottom surface of the hood casing 210 or may be disposed on a virtual plane tilted at a preset angle with respect to the bottom surface of the hood casing 210 to face the front side.

A tilting pin 233 is disposed on each of both surfaces of the second hood 230. The tilting pin 233 may serve as a tilting center of the second hood 230 which is taken in or out of the hood casing 210. The tilting pin 233 extends outward from a front end of each of both side surfaces of the second hood 230. Also, the tilting pin 233 is rotatably supported within the hood casing 210.

Also, first and second stoppers 235 and 237 are disposed on the rear end of the bottom surface and the upper end of the rear surface of the second hood 230, respectively. The first and second stoppers 235 and 237 may restrict the tilted angle of the second hood 230 with respect to the hood casing 210 because the second hood 230 selectively contacts the hook rib 217 when the second hood 230 is taken in or out of the hood casing 210.

In more detail, the first stopper 235 extends backward from the bottom surface of the second hood 230. The first stopper 235 prevents the second hood 230 from being relatively more inserted into the hood casing 210 than the second reception position. For this, when the second hood 230 is received into the hood casing 210, a top surface of the first stopper 235 contacts a bottom surface of the hook rib 217.

In the current embodiment, the hook rib 217 is spaced upward from the bottom surface of the hood casing 210 by a thickness of the first stopper 235. Thus, in the state where the first stopper 235 contacts the bottom surface of the hook rib 217, i.e., the second hood 230 is disposed at the second reception position, the bottom surface of the second hood 230 may be disposed on the same virtual plane as that of the hood casing 210.

The second stopper 237 extends backward from the upper end of the rear surface of the second hood 230. The second stopper 237 prevents the second hood 230 being relatively more taken out of the hood casing than the second withdrawal position. For this, when the second hood 230 is taken out of the hood casing 210, a bottom surface of the second stopper 237 contacts a top surface of the hook rib 217.

The guide members 240 and 250 guide the take-in/out of the first and second hoods 220 and 230 into/from the hood casing 210. Also, in the current embodiment, the guide members 240 and 250 guide the take-in/out of the second hood 230 into/from the hood casing 210 by being linked with the take-in/out of the first hood 220 into/from the hood casing 210. The guide members 240 and 250 include first and second guide members 240 and 250.

In detail, the first guide member 240 guides sliding of the first hood 220 with respect to the hood casing 210. A rail assembly including first and second rails 241 and 243 may be used as the first guide member 240. The first rail 241 is fixed to the inside of both side surfaces of the hood casing 210. Also, the second rail 243 is fixed to the outside of both side surfaces of the first hood 220. Since the second rail 243 is slid along the first rail 241, the first hood 220 is slid forward and backward with respect to the hood casing 210. Thus, the first and second rails 241 and 243 may be called a fixed rail and a movable rail, respectively.

In the current embodiment, a rear end of the first rail 241 is disposed at a front side of the second hood 230. Also, a rear end of the second rail 243 is disposed at a front side of the second hood 230 in the state where the first hood 220 is disposed at the first reception position.

An extension bar 245 is disposed on a rear end of the second rail 243. The extension bar 245 extends backward from the rear end of the second rail 243. Here, a rear end of the extension bar 245 is disposed adjacent to a rear end of a guide slot 253 that will be described later in the state where the first and second hoods 220 and 230 are disposed at the first and second reception positions, respectively. The extension bar 245 may be fixed to the rear end of the second rail 243 as a separate part or integrated with the second rail 243. Alternatively, the extension bar 245 may be fixed to the first hood 220 as a separate part or integrated with the first hood 220.

Also, the second guide member 250 guides tilting of the second hood 230 with respect to the hood casing 210. The second guide member 250 includes a guide plate 251, the guide slot 253, and a guide protrusion 255.

In detail, the guide plate 251 is disposed on both side surfaces of the second hood 230. The guide plate 251 may be defined by both side surfaces of the second hood 230.

A portion of the guide plate 251 is cut in a predetermined shape to define the guide slot 253. The guide slot 253 includes a curved section 253A and a linear section 253B. The curved section 253A is curved with a predetermined curvature in consideration of the tilted angle of the second hood 230. Substantially, a distance of the curved section 253A may be set to a value less than a distance by which the first hood 220 is moved from the first withdrawal position to the first reception position. Also, the linear section 253B extends from a rear end of the curved section 253A in a direction parallel to the bottom surface of the second hood 230.

The linear section 253B prevents an external force from being applied to the second hood 230 in a direction in which the second hood 230 is received into the hood casing 210 in the state where the second hood 230 is disposed at the second reception position due to the movement of the first hood 220 in a case where the second hood 230 is disposed at the second reception position before the first hood 220 is disposed at the first reception position when the first and second hoods 220 and 230 are received into the hood casing 210. That is, when the curved section 253A has a length less than a distance between the first withdrawal position and the first reception position, the movement of the second hood 230 corresponding to the distance difference may be corrected in the linear section 253B. Also, the sum of the lengths of the curved section 253A and the linear section 253B may be decided to a value greater than the movement distance of the first hood 220 between the first withdrawal position and the first reception position.

The guide protrusion 255 is slid along the guide slot 253 in a state where the guide protrusion 255 is disposed on the guide slot 253. Substantially, when the guide protrusion 255 is moved along the curved section 253A, the second hood 230 is tilted at a preset angle with respect to the hood casing 210. However, when the guide slot 253 is moved along the linear section 253B, the second hood 230 may be maintained in the state the second hood 230 is received into the hood casing 210, i.e., disposed at the second reception position without being tilted with respect to the hood casing 210. For example, in the state where the second hood 230 is disposed at the second reception position, the guide protrusion 255 is disposed on a rear end of the guide slot 253, substantially, on the linear section 253B. Also, in the state where the second hood 230 is disposed at the second withdrawal position, the guide protrusion 255 is disposed on a front end of the guide slot 253, substantially, a front end of the curved section 253A. Also, when the second hood 230 is tilted with respect to the hood casing 210, i.e., the second hood 230 is taken in or out of the hood casing 210, the guide protrusion 255 is moved forward or backward along the guide slot 253.

In the current embodiment, the guide protrusion 255 is fixed to a rear end of the extension bar 245. Thus, when the first hood 220 is slid into/from the hood casing 210, the guide protrusion 255 is slid along the guide slot 253. Thus, the second hood 230 is tilted into/from the hood casing 210.

Thus, the second hood 230 is taken in or out of the hood casing 210 by being linked with the take-in/out of the first hood 220 from/into the hood casing 210 by the extension bar 245, the guide protrusion 255, and the guide slot 253. That is, the second hood 22 may be tilted and taken out in a state where the first hood 220 is taken out by a predetermined distance. Thus, the extension bar 245, the guide protrusion 255, and the guide slot 253 may be called linkage members in which the second hood 230 is tilted with respect to the hood casing 210 by being linked with the sliding of the first hood 220 with respect to the hood casing 210.

The elastic member (not shown) provides an elastic force in a direction in which the first hood 220 is taken out of the hood casing 210, i.e., the first hood 220 is moved into the first withdrawal position. Thus, the first hood 220 is taken out of the hood case 210 by the elastic force of the elastic member.

Also, the locking device (not shown) prevents the first hood 220 from being randomly taken out of the hood casing 210 by the elastic force of the elastic member in the state where the first hood 220 is received into the hood casing 210. In other words, the locking device selectively enables the sliding of the first hood 220 by the elastic force of the elastic member in the state where the first hood 220 is disposed at the first reception position. For example, the locking device may include a latch module (not shown) and a latch hook (not shown). The latch module may be fixed to the hood casing 210, and the latch hook may be fixed to the first hook 220. Also, since the latch hook is selectively engaged with the latch module by an external force applied into the first hood 220 in the direction in which the first hood 220 is received into the hood casing 210, the sliding of the first hood 220 with respect to the hood casing 210 may be selectively enabled. Here, the elastic member and the locking device may be omitted.

The suction fan 260 is disposed within the main body 110. The suction fan 260 suctions air containing contaminants into the main body 110 to discharge the air into the outside of the main body 110, i.e., the indoor or outdoor space. That is, when the suction fan 260 is driven, the air containing the contaminants is suctioned into the main body 110 through the first and second auxiliary suction holes 221 and 231. Also, the air containing the contaminants suctioned into the main body 110 flows into the main suction passage P3, the first and second auxiliary suction passages P4 and P5, the connection passage P1 or/and the indoor exhaust passage P2 by the continuous operation of the suction fan 260, and then is discharged into the indoor or outdoor space through the indoor exhaust hole 117 or the outdoor exhaust hole 119. In the current embodiment, although the suction fan 260 is disposed on a connection portion between the connection passage P1 and the indoor exhaust passage P2, the present disclosure is not limited to the position of the suction fan 260.

A lamp (not shown) may be disposed within the hood casing 210. The lamp may illuminate a lower side of the microwave oven 100.

Hereinafter, an effect of the microwave oven having the hood according to the first embodiment will be described in detail with reference to the accompanying drawings.

Figure 3:
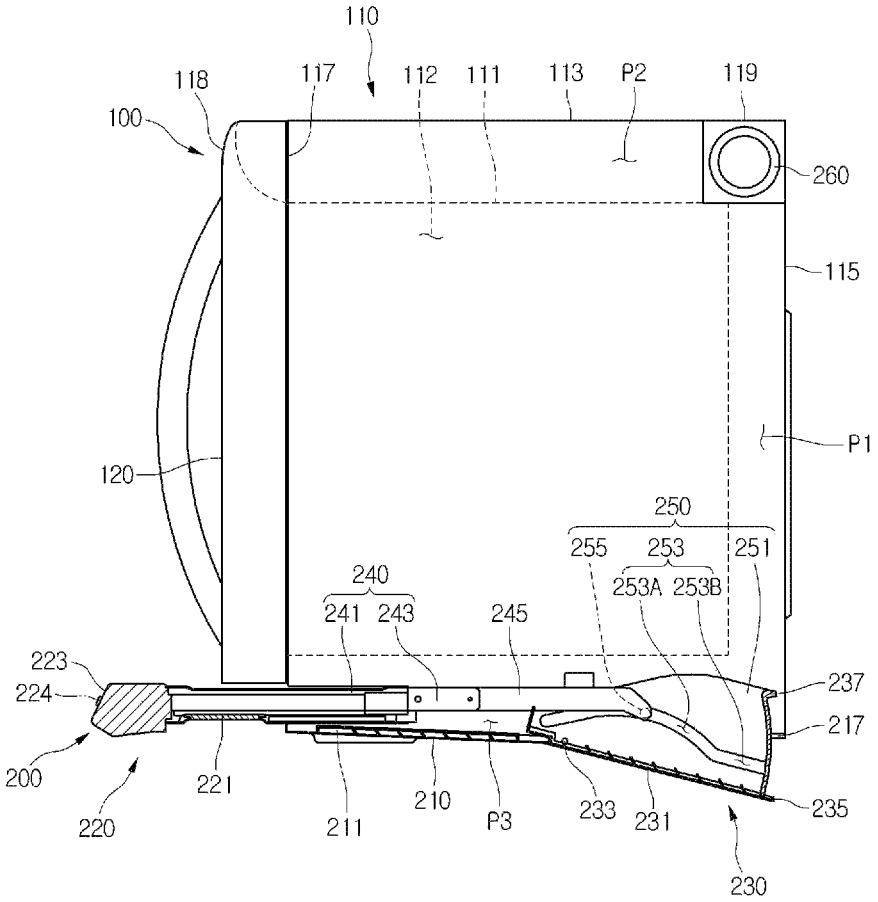
FIGS. 3 and 4 are views illustrating an operation of the hood of the microwave oven having the hood according to the first embodiment.

FIGS. 3 and 4 are views illustrating an operation of the hood of the microwave oven having the hood according to the first embodiment.

In the state where the first and second hoods 220 and 230 are received into the hood casing 210 (see FIG. 2), i.e., the first and second hoods 220 and 230 are disposed at the first and second reception positions, respectively, an external force is applied to the first hood 220 in a direction in which the first hood 220 is received into the hood casing 210. Thus, the locking device is released, and the first hood 220 is taken out of the hood casing 210 by the elastic force of the elastic member, i.e., is moved into the first withdrawal position. Also, the second hood 230 is taken out of the hood casing 210 by being linked with the take-out of the first hood 220, i.e., is moved into the second withdrawal position.

In detail, the first hood 220 is moved in a left direction of each of FIGS. 2 to 4 by the elastic force of the elastic member and then disposed at the first withdrawal position. Here, the take-out of the first hood 220 is guided by the first guide member 240. That is, when the first hood 220 is moved in the left direction in the drawings, the take-out of the first hood 220 is guided while the second rail 243 is moved along the first rail 241 in the left direction in the drawings.

When the second rail 243 is moved along the first rail 241 while the first hood 220 is taken out of the hood casing 210, the extension bar 245 fixed to or integrated with the second rail 243 is substantially moved in the left direction in the drawings. Thus, the second hood 230 is taken out of the hood casing 210 while the guide protrusion 255 is moved along the guide slot 253. Here, the guide protrusion 255 is successively moved along the linear section 253B and the curved section 253A.

Also, when the first hood 220 is disposed at the first withdrawal position, the guide protrusion 255 is disposed on the front end of the curved section 253A. Even though a distance of the curved section 253A is greater than that in which the first hood 220 is moved from the first reception position to the first withdrawal position, the second stopper 237 is hooked on the hook rib 217. Thus, the state in which the second hood 230 is disposed at the second withdrawal position may be maintained.

As described above, when the suction fan 260 is operated in the state where the first and second hoods 220 and 230 are taken out of the hood casing 210, the air containing the contaminants is suctioned into the main body 110 through the main suction hole 211 and the first and second auxiliary suction holes 221 and 231. Also, the air containing the contaminants suctioned through the main suction hole 211 and the first and second auxiliary suction holes 221 and 231 flows into the main suction passage P3 or the first and second auxiliary suction passages P4 and P5 and the main suction passage P3 and then is transferred into the connection passage P1. The air containing the contaminants transferred into the connection passage P1 flows into the indoor exhaust passage P2 and then is discharged into the indoor space through the indoor exhaust hole 117 or into the outdoor space through the outdoor exhaust hole 118.

The process for receiving the first and second hoods 220 and 230 into the hood casing 210, i.e., the process for moving the first and second hoods 220 and 230 from the first and second withdrawal positions to the first and second reception positions may be reversely performed with respect to the above-described take-out process. That is, the user applies an external force to the first hood 220 in the direction in which the first hood 220 is received into the hood casing 210, i.e., in the left direction in the drawings. Thus, the first hood 220 overcomes the elastic force of the elastic member and is received into the hood casing 210. Then, the locking device is locked, and thus, the state in which the first hood 220 is received into the hood casing 210, i.e., the first hood 220 is disposed at the first reception position is maintained. As described above, when the first hood 220 is received into the hood casing 210, the second rail 243 is moved along the first rail 41 in a right direction in the drawings.

When the second rail 243 is moved in the right direction in the drawings, the guide protrusion 255 is moved along the guide slot 253. Thus, the second hood 230 is received into the hood casing 210. Here, a deviation of the distances when the first and second hoods 220 and 230 are received into the hood casing 210 is corrected by the linear section 253B. Also, when the second hood 230 is received into the hood casing 210, i.e., disposed at the second reception position, the first stopper 235 is hooked on the hook rib 217. Thus, it may prevent the second hood 230 from being more inserted into the hood casing 210.

Hereinafter, a microwave oven having a hood according to the second embodiment will be described in detail with reference to the accompanying drawings.

Figure 5:
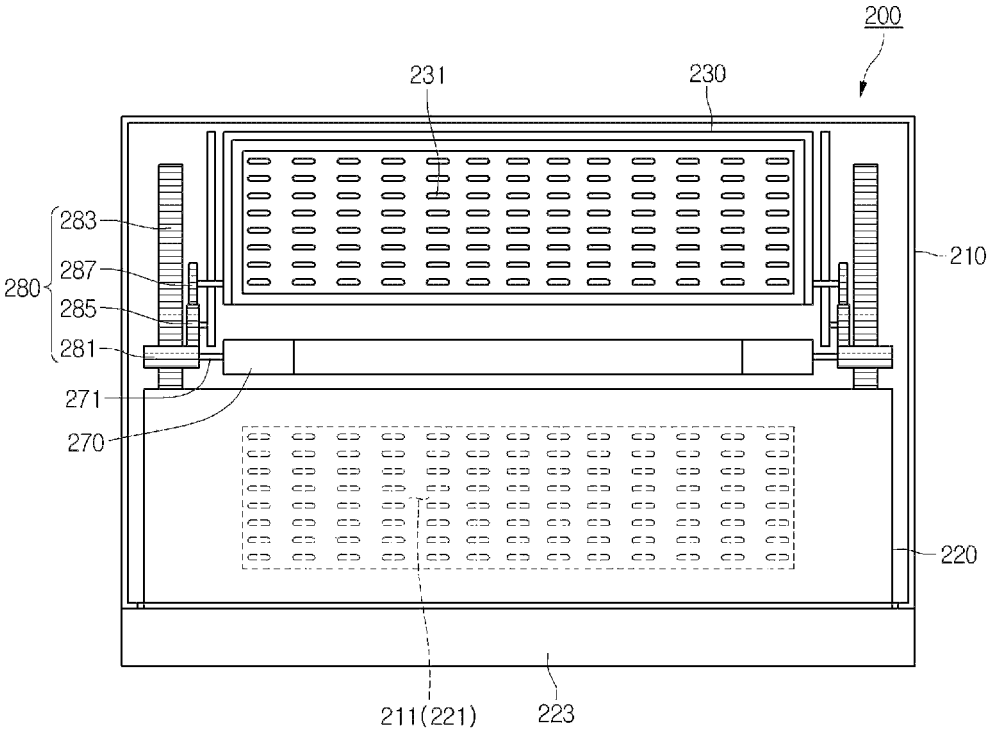
FIG. 5 is a plan view of a microwave oven having a hood according to a second embodiment.

FIG. 5 is a plan view of a microwave oven having a hood according to a second embodiment. The same components as those of the first embodiment will be derived from FIGS. 1 to 4, and thus detailed descriptions thereof will be omitted.

Referring to FIG. 5, in the current embodiment, first and second hoods 220 and 230 are taken in or out of a hood casing 210 by a driving force of a driving motor 270. That is, when the driving motor 270 is driven, the first and second hoods 220 and 230 are taken in or out of the hood casing 210.

In detail, the driving motor 270 is disposed within the hood casing 210. A bidirectionally rotatable step motor may be used as the driving motor 270.

Also, the driving force of the driving motor 270 may be transmitted into the first and second hoods 220 and 230 by a driving force transmission member. The driving force transmission member 280 includes a driving gear 281, a rack 283, and first and second driven gears 285 and 287.

The driving gear 281 is connected to a motor shaft 271 of the driving motor 270. The rack 283 is disposed on the first hood 220. The rack 283 extends backward from a rear end of the first hood 220. Also, the rack 283 is gear-coupled to the driving gear 281. The first driven gear 165 is gear-coupled to the driving gear 281, and the second driven gear 287 is gear-coupled to the first driven gear 285. Also, the second driven gear 287 is coupled to a tilting pin 233 of the second hood 230.

Thus, when the driving gear 281 is rotated in one direction (hereinafter, referred to as a "normal direction"), the rack 283 is moved forward. Thus, the first hood 220 is slid forward with respect to the hood casing 210 and is taken out of the hood casing 210. When the driving gear 281 is rotated in an opposite direction (hereinafter, referred to as a "reverse direction), the rack 283 is moved backward. Thus, the first hood 220 is slid backward with respect to the hood casing 210 and is received into the hood casing 210. Also, when the driving motor 270 is rotated in the normal or reverse direction, the driving force of the driving motor 270 is transmitted by the driving gear 281 and the first and second driven gears 285 and 287. As a result, the second hood 230 is tilted and taken in or out of the hood casing 210.

Thus, in the current embodiment, the driving force of the driving motor 270 is transmitted into the first and second hoods 220 and 230 by the driving force transmission member 280. Thus, the first and second hoods 220 and 230 may be taken in or out of the hood casing 210 at the same time by the driving of the driving motor 270. Also, the driving force transmission member 280 may be determined according to a moving distance of the first hood 220 and a tilted angle of the second hood 230. For example, the driving force transmission member 280 may further include an additional driven gear or decide a gear ratio of the driving gear 281 and the first and second driven gears 285 and 287 according to the moving distance of the first hood 220 and the tilted angle of the second hood 230.

It should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

In the foregoing embodiments, a hood slidable with respect to the hood casing was called the first hood, and a hood tiltable with respect to the hood casing was called the second hood. Thus, the first and second hood may be called a sliding hood or a tilting hood according to the moving method with respect to the hood casing.

Also, the hook rib and the first and second stoppers substantially restrict the tilted angle of the second hood with respect to the hood casing. Thus, the hook rib and the first and second stoppers may be called a stopping member.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A microwave oven having a hood, the microwave oven comprising:

a main body having a cooking chamber in which foods are cooked and a passage through which air containing contaminants flows;

a hood casing on a bottom surface of the main body, the hood casing having a main suction hole for suctioning the air containing the contaminants;

a first hood able to be taken out of the hood casing forward from the inside of the hood casing;

a second hood tiltable at a predetermined angle from the inside of the hood casing and able to be taken out of the hood casing;

a guide slot in the second hood; and a guide protrusion on the guide slot, wherein, when the guide protrusion is movable along the guide slot, the second hood is tiltable with respect to the hood casing.

2. The microwave oven according to claim 1, wherein, when the first hood is taken in or out, the second hood is taken in or out by being linked with the first hood.

3. The microwave oven according to claim 1, wherein the first hood is linearly moved, and wherein the second hood is linked with the movement of the first hood and taken out of the hood casing by a tilting operation thereof.

4. The microwave oven according to claim 3, wherein the tilting operation of the second hood starts in a state where the first hood is moved by a predetermined distance.

5. The microwave oven according to claim 1, further comprising:

a fixed rail fixed to the hood casing; and a movable rail fixed to the first hood and moved along the fixed rail.

6. The microwave oven according to claim 5, wherein the guide protrusion is on an extension bar connected to the first hood or the movable rail.

7. The microwave oven according to claim 1, wherein the guide slot comprises:

a curved section curved with a preset curvature; and a linear section linearly extending from a rear end of the curved section, wherein, when the guide protrusion is moved along the curved section, the second hood is tilted with respect to the hood casing and taken in or out of the hood casing, and when the guide protrusion is moved along the linear section, a state in which the second hood is received into the hood casing is maintained.

8. The microwave oven according to claim 7, wherein a sum of lengths of the curved section and the linear section is set to a value greater than a sliding distance of the first hood with respect to the hood casing.

9. The microwave oven according to claim 1, further comprising a stopping member that restricts a tilting range of the second hood with respect to the hood casing.

10. The microwave oven according to claim 9, wherein the stopping member comprises:

a hook rib on the hood casing;

a first stopper hooked on the hook rib in a state where the second hood is received into the hood casing; and a second stopper hooked on the hook rib in a state where the second hood is taken out of the hood casing.

11. The microwave oven according to claim 1, further comprising:

a driving motor that provides a driving force for taking the first hood and the second hood in or out; and a driving force transmission member that transmits the driving force of the driving motor into the first hood and the second hood.

12. The microwave oven according to claim 11, wherein the driving force transmission member comprises:

a driving gear coupled to the driving motor;

a rack fixed to the first hood, the rack being gear-coupled to the driving gear; and at least one driven gear gear-coupled to the driving gear, the at least one driven gear being coupled to a tilting pin of the second hood.

13. The microwave oven according to claim 1, further comprising:

a guide plate on the second hood; and an extension bar slid together with the first hood, wherein the guide slot is defined by cutting a portion of the guide plate, wherein the guide protrusion is provided on a side of the extension bar and the guide protrusion is on the guide slot.

14. The microwave oven according to claim 1, wherein a hook protrusion is on the hood casing, wherein a first stopper and a second stopper are on the second hood, and when the second hood is tilted with respect to the hood casing, one of the first and the second stoppers is hooked on the hook protrusion to restrict a tilted angle of the second hood with respect to the hood casing.

* * * * *